US009650905B2

(12) United States Patent
Earl et al.

(10) Patent No.: US 9,650,905 B2
(45) Date of Patent: May 16, 2017

(54) SINGLET VANE CLUSTER ASSEMBLY

(75) Inventors: Jonathan J. Earl, Wells, ME (US); Eric A. Kuehne, Lyman, ME (US)

(73) Assignee: United Technologies Corporation, Hartford, CT (US)

( * ) Notice: Subject to any disclaimer, the term of this patent is extended or adjusted under 35 U.S.C. 154(b) by 621 days.

(21) Appl. No.: 13/596,194

(22) Filed: Aug. 28, 2012

(65) Prior Publication Data

US 2014/0060081 A1 Mar. 6, 2014

(51) Int. Cl.
*F01D 9/00* (2006.01)
*F01D 9/04* (2006.01)
*F01D 25/24* (2006.01)

(52) U.S. Cl.
CPC ..... *F01D 9/042* (2013.01); *F01D 25/246* (2013.01); *F05D 2230/60* (2013.01); *F05D 2260/30* (2013.01); *Y10T 29/49229* (2015.01)

(58) Field of Classification Search
CPC ..... F01D 9/00; F01D 9/02; F01D 9/04; F01D 9/041; F01D 9/042; F01D 25/24; F01D 25/246; F05D 2230/60; F05D 2260/30; Y10T 29/49229
USPC ..... 60/805; 415/191, 196, 208.1, 209.2, 415/209.3
See application file for complete search history.

(56) References Cited

U.S. PATENT DOCUMENTS 3,542,483 A * 11/1970 Gagliardi ..... 415/136
4,314,792 A 2/1982 Chaplin
4,439,982 A * 4/1984 Weiler et al. ..... 60/805
4,492,517 A * 1/1985 Klompas ..... F01D 5/185 415/115
4,868,963 A 9/1989 Corsmeier et al.
5,141,395 A 8/1992 Carroll et al.
6,173,491 B1 1/2001 Goodwater et al.
6,394,750 B1 5/2002 Hiskes
6,553,665 B2 4/2003 Gunn et al.
6,910,854 B2 6/2005 Joslin
7,059,832 B2 * 6/2006 Bertrand et al. ..... 415/209.2
7,101,150 B2 9/2006 Bash et al.
7,144,218 B2 * 12/2006 Dube ..... F01D 25/246 415/189
7,278,821 B1 * 10/2007 O'Reilly et al. ..... 415/189
7,510,369 B2 * 3/2009 Lytle ..... 415/160
8,220,150 B2 7/2012 Pellet et al.
(Continued)

FOREIGN PATENT DOCUMENTS

DE 102007059220 6/2009
EP 1657405 5/2006
(Continued)

OTHER PUBLICATIONS

International Search Report and Written Opinion for International Application No. PCT/US2013/055491 completed on Jun. 2, 2014.
(Continued)

*Primary Examiner* — Phutthiwat Wongwian
*Assistant Examiner* — Jason H Duger
(74) *Attorney, Agent, or Firm* — Carlson, Gaskey & Olds, P.C.

(57) ABSTRACT

A vane cluster for a gas turbine engine includes multiple singlet vanes and a forward wear liner connecting a forward edge of each singlet vane, thereby allowing the vane cluster to be manipulated as a single component.

21 Claims, 6 Drawing Sheets

(56) References Cited

U.S. PATENT DOCUMENTS

| | | | | |
|---|---|---|---|---|
| 8,419,361 | B2 * | 4/2013 | Robertson | B01D 46/02 415/209.2 |
| 8,534,997 | B2 * | 9/2013 | Guemmer | F01D 5/146 415/181 |
| 8,961,111 | B2 * | 2/2015 | Benson | F01D 5/187 415/1 |
| 2002/0048512 | A1 * | 4/2002 | Olivier Cot et al. | 415/173.1 |
| 2007/0258818 | A1 | 11/2007 | Allen-Bradley et al. | |
| 2007/0258819 | A1 | 11/2007 | Allen-Bradley et al. | |
| 2008/0284179 | A1 | 11/2008 | Gerner et al. | |
| 2009/0169369 | A1 | 7/2009 | Morgan et al. | |
| 2009/0317241 | A1 * | 12/2009 | Major | 415/148 |
| 2010/0068050 | A1 * | 3/2010 | Hansen et al. | 415/209.3 |
| 2012/0024717 | A1 | 2/2012 | Roeblitz et al. | |

FOREIGN PATENT DOCUMENTS

| | | |
|---|---|---|
| EP | 2613021 | 7/2013 |
| WO | 2014022065 | 2/2014 |

OTHER PUBLICATIONS

International Preliminary Report on Patentability for International Application No. PCT/US2013/055491 mailed Mar. 12, 2015.
Extended European Search Report for Application No. 13854037.2 dated Jun. 20, 2016.

* cited by examiner

SINGLET VANE CLUSTER ASSEMBLY

TECHNICAL FIELD

The present disclosure is directed toward vane assemblies for gas turbine engines, and more particularly to a singlet vane cluster for use in a gas turbine engine.

BACKGROUND OF THE INVENTION

Gas turbine engines, such as those used on commercial aircraft, include a compressor section, a combustor section, and a turbine section. Passing through each of the sections is a gas flowpath that allows a gas to flow through the engine, and thereby allows the engine to function. Included within the gas flowpath are multiple rotors, stators, and vanes. The rotors and stators operate to either compress the gas flowing through the gas flowpath or to expand the gas, causing the turbine to spin. The vanes are positioned in the gas flowpath and impart desirable flow characteristics on the gas as it flows through the gas flowpath.

The vanes can be individual vanes, referred to as singlet vanes, or components with multiple vane blades. When singlet vanes are utilized, each singlet vane is installed in the vane assembly individually in a time consuming process that is prone to human error.

SUMMARY OF THE INVENTION

A gas turbine engine vane cluster according to an exemplary embodiment of this disclosure, among other possible things includes a plurality of singlet vanes including an anti-rotation singlet vane and an end vane singlet vane, and a forward wear liner connecting a forward edge of each singlet vane in the plurality of singlet vanes, such that the plurality of singlet vanes is operable to be manipulated as a single component.

In a further embodiment of the foregoing gas turbine engine vane cluster, the plurality of singlet vanes includes the anti-rotation singlet vane on a first end, the end vane singlet vane on an opposite end, and at least one intermediate vane between the anti-rotation singlet vane and the end vane singlet vane, and wherein each of the singlet vanes interfaces with each adjacent singlet vane in the vane cluster.

In a further embodiment of the foregoing gas turbine engine vane cluster, further comprising an aft wear liner connecting an aft edge of each singlet vane in the plurality of singlet vanes.

In a further embodiment of the foregoing gas turbine engine vane cluster, the anti-rotation singlet vane 130 includes an anti-rotation notch and a forward wear liner retention notch.

In a further embodiment of the foregoing gas turbine engine vane cluster, the end vane singlet vane includes a forward retention lug interfaced with the forward wear liner and an aft retention lug 430 interfaced with the aft wear liner.

In a further embodiment of the foregoing gas turbine engine vane cluster, the forward wear liner comprises an anti-rotation interface feature operable to interface with the anti-rotation singlet vane on a first end of the forward wear liner, and an end vane singlet vane interface feature on a second end of the forward wear liner.

In a further embodiment of the foregoing gas turbine engine vane cluster, the anti-rotation interface feature comprises a gap offset from a first end of the forward wear liner and an extended wear liner flap, and the end vane singlet vane interface feature comprises a gap offset from the second end of the forward wear liner.

In a further embodiment of the foregoing gas turbine engine vane cluster, the aft wear liner comprises an end vane singlet vane interface feature, wherein the end vane singlet vane interface feature is a notch on an end of the aft wear liner, and wherein an aft end vane singlet vane liner interface lug interfaces with the end vane singlet vane interface feature.

In a further embodiment of the foregoing gas turbine engine vane cluster, the forward wear liner includes an anti-rotation singlet vane interface feature, and wherein the anti-rotation singlet vane interface feature is a wear liner flap at least partially extending into an anti-rotation notch in the anti-rotation singlet vane.

In a further embodiment of the foregoing gas turbine engine vane cluster, the forward wear liner further connects an aft edge of each singlet vane in the plurality of singlet vanes, such that the plurality of singlet vanes is capable of being manipulated as a single component.

A method of assembling a gas turbine engine vane cluster according to an exemplary embodiment of this disclosure, among other possible things includes positioning an anti-rotation singlet vane in a forward wear liner, such that a forward wear liner retention notch interfaces with the forward wear liner thereby holding the forward wear liner in place, sliding at least one standard singlet vane into the forward wear liner, such that the forward wear liner connects a forward edge of each standard singlet vane and a forward edge of the anti-rotation singlet vane, sliding an aft wear liner onto an aft edge of each standard singlet vane, such that a first edge of the aft wear liner abuts the anti-rotation singlet vane, and sliding an end vane singlet vane into the forward wear liner and the aft wear liner such that a forward retention lug snaps into an end vane singlet vane interface feature of the forward wear liner, and an aft retention lug slides into an end vane singlet vane interface feature of the aft wear liner.

In a further embodiment of the foregoing method, the step of sliding at least one standard singlet vane into the forward wear liner, such that the forward wear liner connects a forward edge of each standard singlet vane and a forward edge of the anti-rotation singlet vane further comprises interfacing each singlet vane, in the vane cluster with each adjacent singlet vane in the cluster.

In a further embodiment of the foregoing method, the step of sliding an aft wear liner onto an aft edge of each standard singlet vane, such that a first edge of the aft wear liner abuts the anti-rotation singlet vane further comprises connecting an aft edge of each of the standard singlet vanes and the end vane singlet vane.

In a further embodiment of the foregoing method, the step of sliding at least one standard singlet vane into the forward wear liner, such that the forward wear liner connects a forward edge of each standard singlet vane and a forward edge of the anti-rotation singlet vane further comprises sliding a specialized singlet vane into the forward wear liner.

A turbine engine according to an exemplary embodiment of this disclosure, among other possible things includes a compressor section, a combustor in fluid communication with the compressor section, a turbine section in fluid communication with the combustor, a vane assembly, wherein the vane assembly comprises a plurality of gas turbine engine vane clusters arranged in a ring about a centerline axis of the gas turbine engine, and wherein each of the gas turbine engine vane clusters comprises a plurality of singlet vanes including an anti-rotation singlet vane and an end vane singlet vane, and a forward wear liner connecting a forward edge of each singlet vane in the plurality of singlet vanes, such that the plurality of singlet vanes is operable to be manipulated as a single component.

In a further embodiment of the foregoing gas turbine engine, each of the plurality of gas turbine engine vane clusters includes an identical number of singlet vanes.

In a further embodiment of the foregoing gas turbine engine, each of the plurality of gas turbine engine vane clusters is identical.

In a further embodiment of the foregoing gas turbine engine, the plurality of gas turbine engine vane clusters comprises at least a first vane cluster configuration and a second vane cluster configuration, wherein each of the first vane cluster configuration and the second vane cluster configuration is different.

These and other features of the present invention can be best understood from the following specification and drawings, the following of which is a brief description.

DETAILED DESCRIPTION

Figure 1:
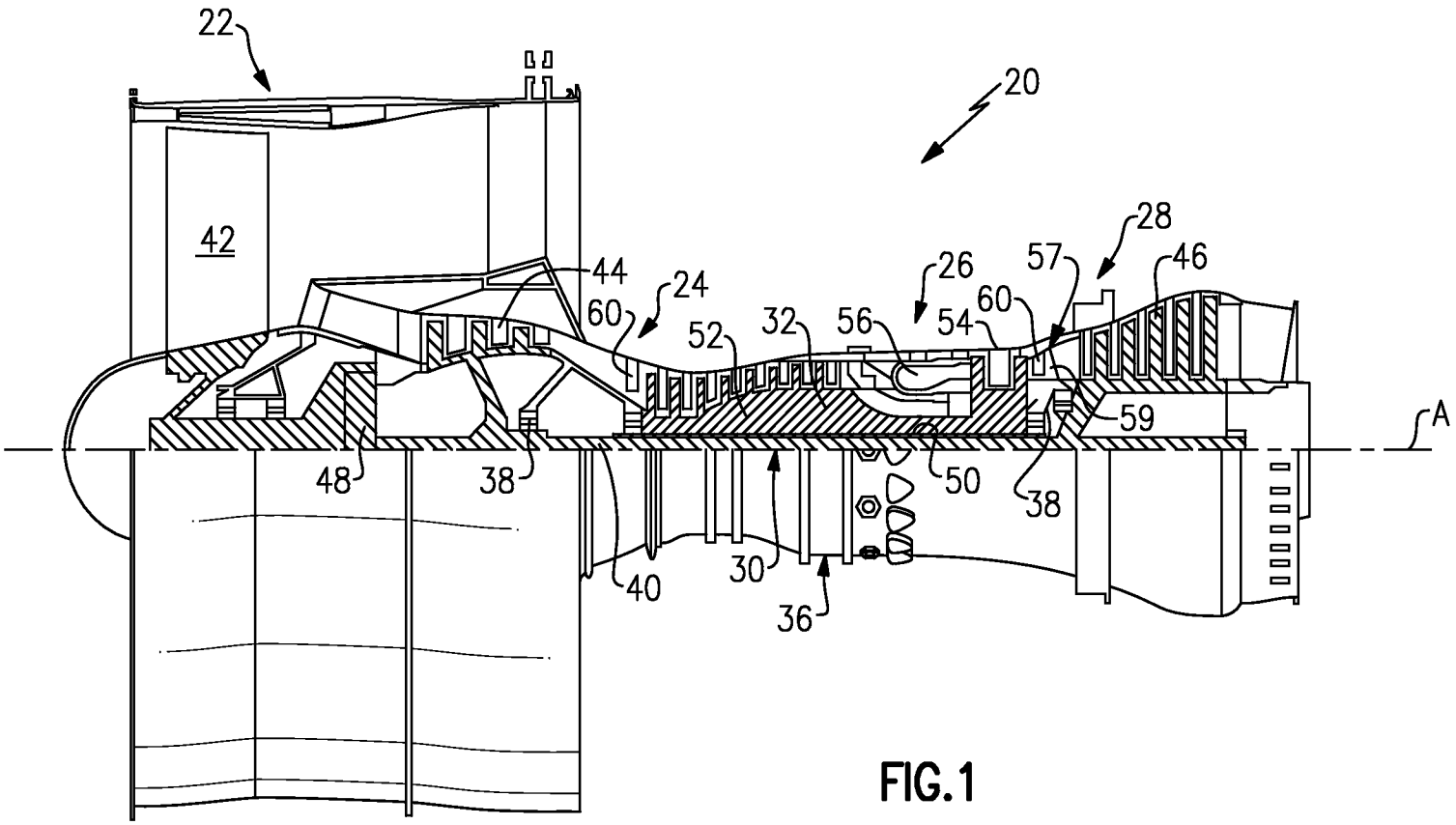
FIG. 1 illustrates a highly schematic drawing of an example gas turbine engine vane assembly.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

Multiple vane assemblies 60 are used throughout the core flowpath to impart desirable flow characteristics on the gas flowing through the core flowpath. Each of the vane assemblies 60 has at least one row of foil shaped vanes mounted circumferentially about the engine central longitudinal axis A. One style of vane assembly 60 utilizes singlet vanes to form the vane assembly 60. The vanes are referred to as singlet vanes because each vane in the vane assembly is a separate, discrete, component. Any given vane assembly 60 utilizes multiple different types of singlet vanes that should be precisely ordered within the vane assembly 60.

In order to ease assembly, and ensure that the singlet vanes are installed in the correct order, the singlet vanes are assembled into vane clusters having multiple singlet vanes. The utilization of vane clusters makes installing the vane assembly less prone to human error, as the singlet vanes are less likely to be installed in an incorrect order. It is understood, in light of this disclosure, that multiple different vane clusters including different numbers of and types of singlet vanes can be utilized in a single vane assembly 60.

Figure 2:
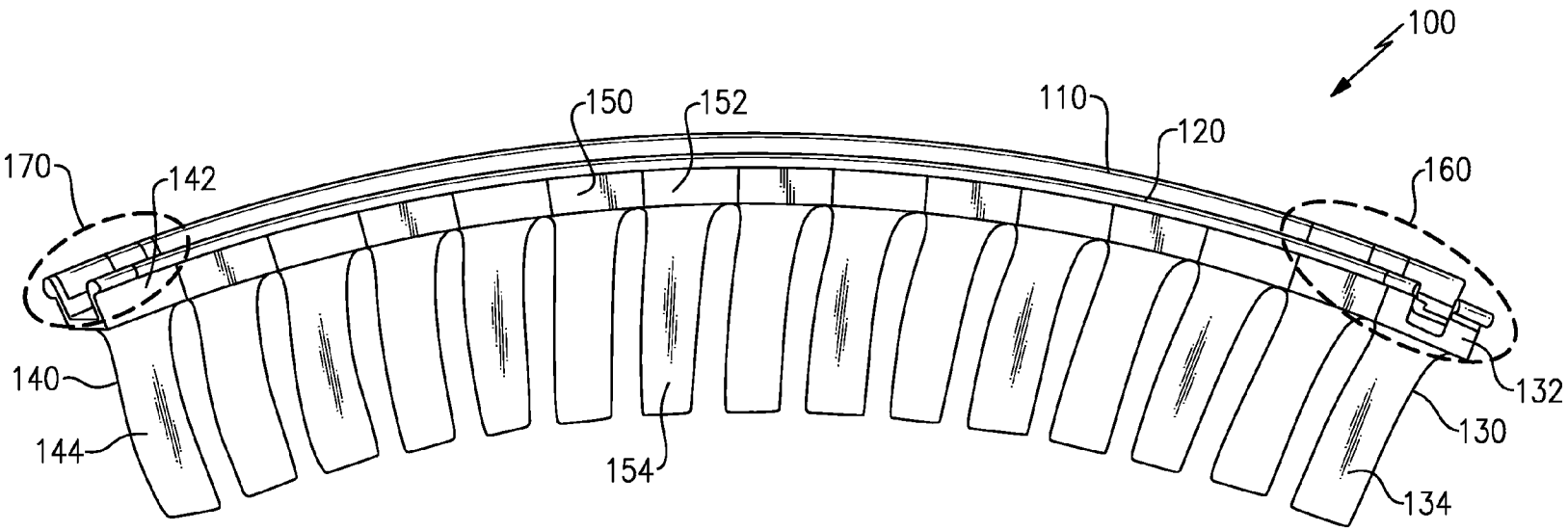
FIG. 2 schematically illustrates a single vane cluster assembly for use in a gas turbine engine.

FIG. 2 illustrates a vane cluster 100 that can be used in the vane assemblies 60 of the example gas turbine engine of FIG. 1. The vane cluster 100 is constructed of multiple individual standard singlet vanes 150 between an anti-rotation vane 130 and an end vane 140, both of which are singlet vanes. A forward wear liner 110 connects a forward edge of a base portion 132, 142, 152 of each of the singlet vanes 150, 140, and 130, and an aft wear liner 120 connects an aft edge of a base portion 132, 142, 152 of each of the singlet vanes 130, 140, 150. The forward edge refers to the edge facing a gas intake portion of the core flowpath, and the aft edge refers to the edge facing a gas exit of the core flowpath.

Each of the singlet vanes 130, 140, 150 is a distinct, separable, component with a base portion 132, 142, 152 and a blade portion 134, 144, 154. The base portions of each of the singlet vanes 130, 140, 150 are shaped to interface with each of the adjacent singlet vane 130, 140, 150 in the vane cluster 100. In alternate examples, additional specialized singlet vanes are included in place of one or more of the standard singlet vanes 150. In further alternate examples, a different number of standard singlet vanes 150 is utilized between the end vane 140 and the anti-rotation vane 130.

The forward wear liner 110 connects a forward edge of the base portions 132, 142, 152 of each of the singlet vane 130, 140, 150. Similarly, the aft wear liner 120 connects an aft edge of the base portions 132, 142, 152. The aft wear liner 120 and the forward wear liner 110 protect the singlet vanes 130, 140, 150 from wear damage. The wear liners 110, 120 further hold the vane cluster 100 together as a single component, allowing for a simplified gas turbine engine vane assembly installation.

The forward wear liner 110 and the aft wear liner 120 are retained in place by an anti-rotation vane retention feature 160 on an anti-rotation singlet vane end of the vane cluster 100, and by an end vane retention feature 170 on an end vane singlet vane end of the vane cluster 100.

Figure 3:
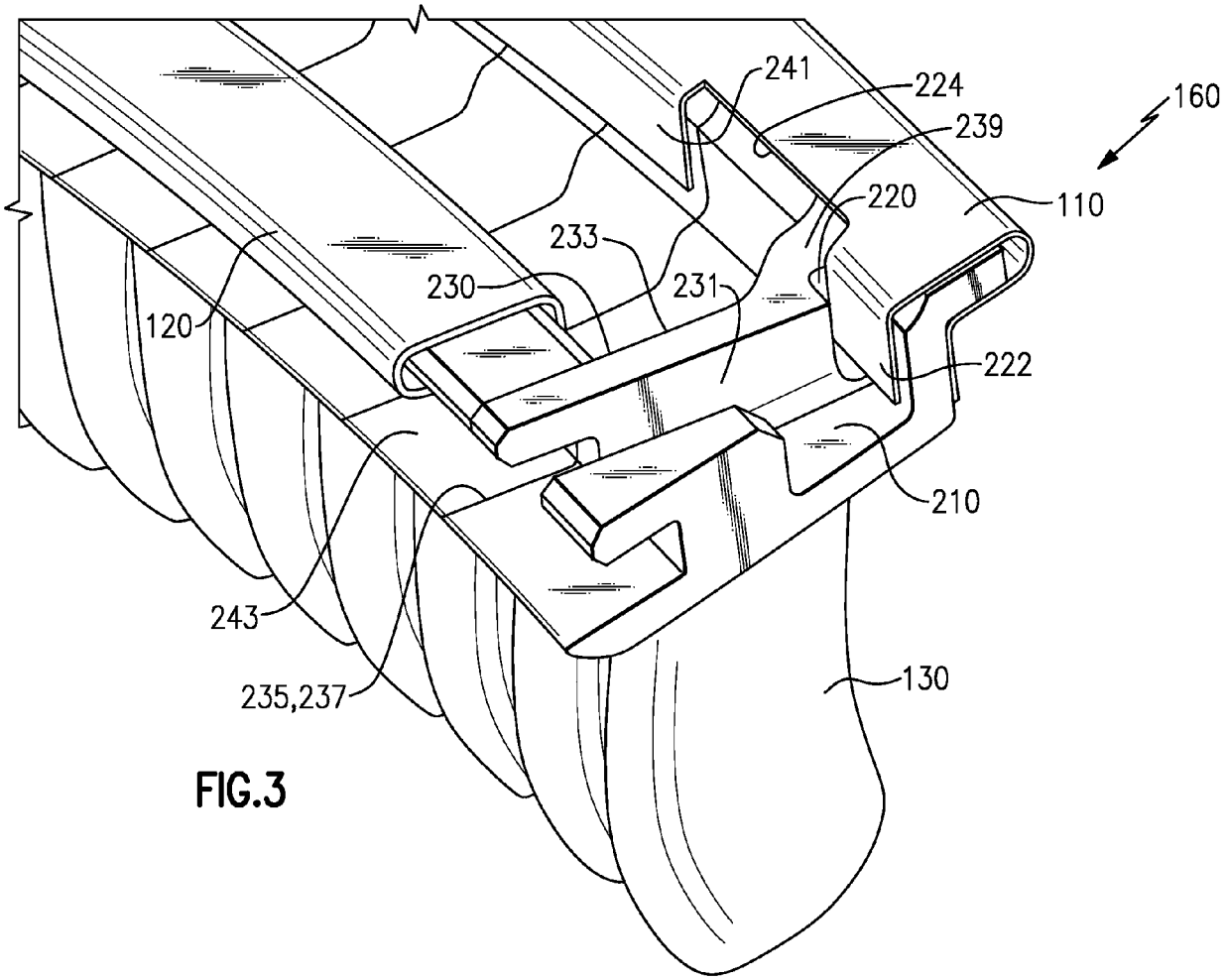
FIG. 3 schematically illustrates a first example anti-rotation singlet vane retention feature of a vane cluster assembly.

With continued reference to FIG. 2, FIG. 3 illustrates a first example anti-rotation retention feature 160 for the anti-rotation vane 130. The anti-rotation vane 130 includes an anti-rotation notch 210 according to known anti-rotation vane designs. The anti-rotation vane 130 also includes a liner retention notch 220 for the forward wear liner 110. An extended liner flap 222 of the forward wear liner 110 extends into, and is retained by, the liner retention notch 220. A raised wall 230 on the anti-rotation singlet vane 130 defines the anti-rotation notch 210 and snaps into a gap 224 in the forward wear liner 110, and includes a first radially aligned surface 231 and a second radially aligned surface 233. The raised wall 230 of the anti-rotation vane 130 is at an axially aligned edge 235 of the anti-rotation vane 130, and is adjacent an axial edge 237 of another singlet vane 243. The gap 224 is defined between the portion of the forward wear liner 110 extending into the liner retention notch 220 (the extended liner flap 222), and a radially aligned wall 241 of the forward wear liner 110. A portion 239 of the raised wall 230 is received in the gap 224 defined in the forward wear liner 110. The aft wear liner 120 abuts the raised wall 230 on the anti-rotation singlet vane 130. In this way, the forward wear liner 110 and the aft wear liner 120 are retained in position by the anti-rotation vane 130, and the anti-rotation vane 130 is held in place by the extended liner flap 222 retained in the forward retention notch 220 of the forward wear liner 110.

Figure 4:
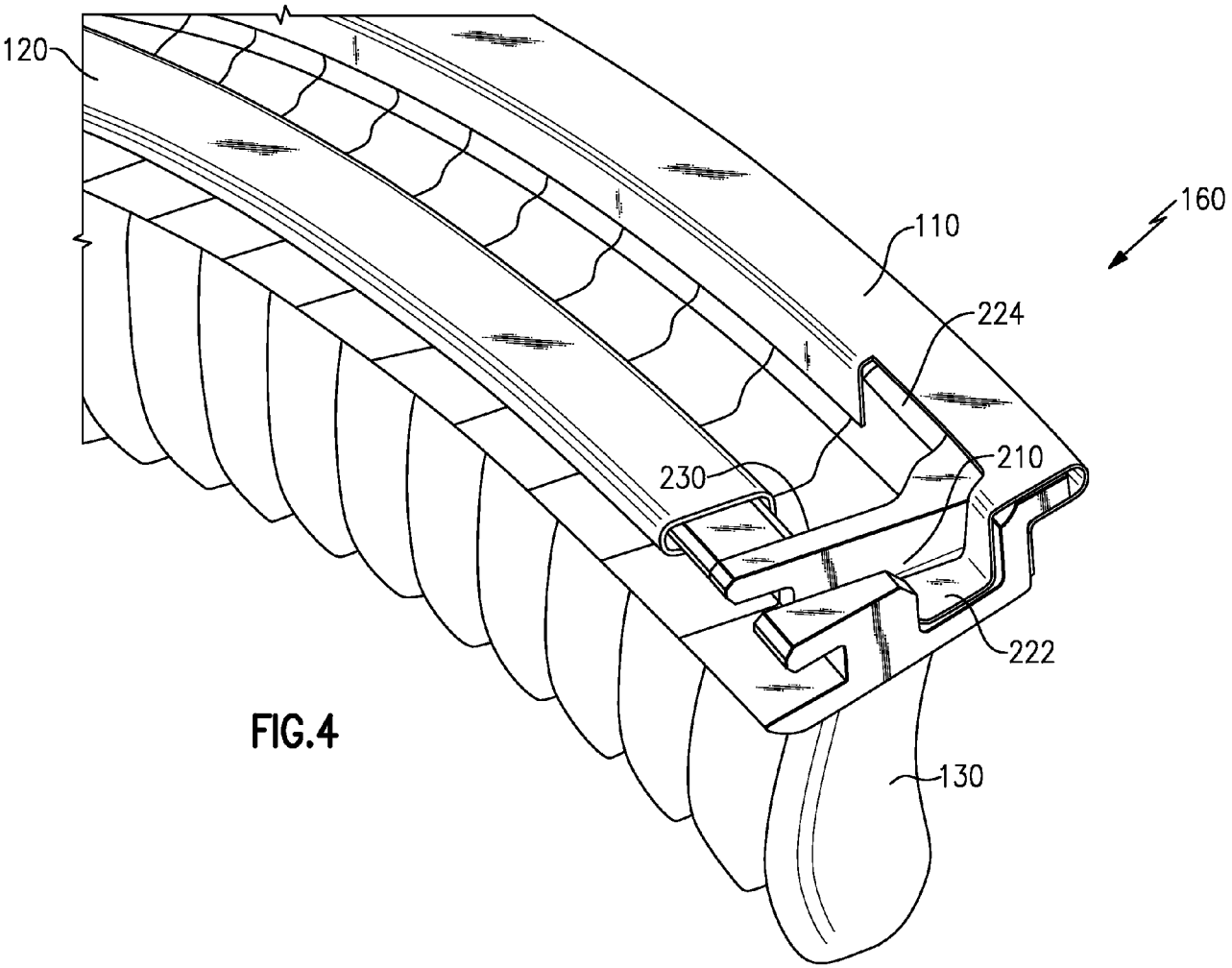
FIG. 4 schematically illustrates a second example anti-rotation singlet vane retention feature of a vane cluster assembly.

With continued reference to FIG. 2, FIG. 4 illustrates a second example anti-rotation singlet vane retention feature 160 for the anti-rotation vane 130. As in the first example (illustrated in FIG. 3), the anti-rotation vane 130 includes a standard anti-rotation notch 210 defined by a raised wall 230. The second example anti-rotation vane retention feature 160 differs from the first example anti-rotation vane retention feature 160, in that the anti-rotation vane 130 of the second example does not include a forward wear liner retention notch. Instead, the forward wear liner 110 of the second example uses the existing anti-rotation notch 210 of the anti-rotation vane 130 to retain the extended liner flap 222 for the forward wear liner. To facilitate this arrangement, the extended liner flap 222 in the second example anti-rotation vane retention feature 160 includes an additional extended portion.

In both the first example and the second example anti-rotation vane retention features 160, the extended liner flap 222 is located on an anti-rotation notch side of the raised wall 230, and the raised wall 230 of the anti-rotation vane 130 is retained in a gap 224 in the forward wear liner 110. This retention of the forward wear liner within the gap 224 coupled with the extended liner flap 222 being retained in either the liner retention notch 220 or the anti-rotation notch 210 maintains the anti-rotation vane 130 in position as well as holding the forward wear liner 110 in position.

Figure 5:
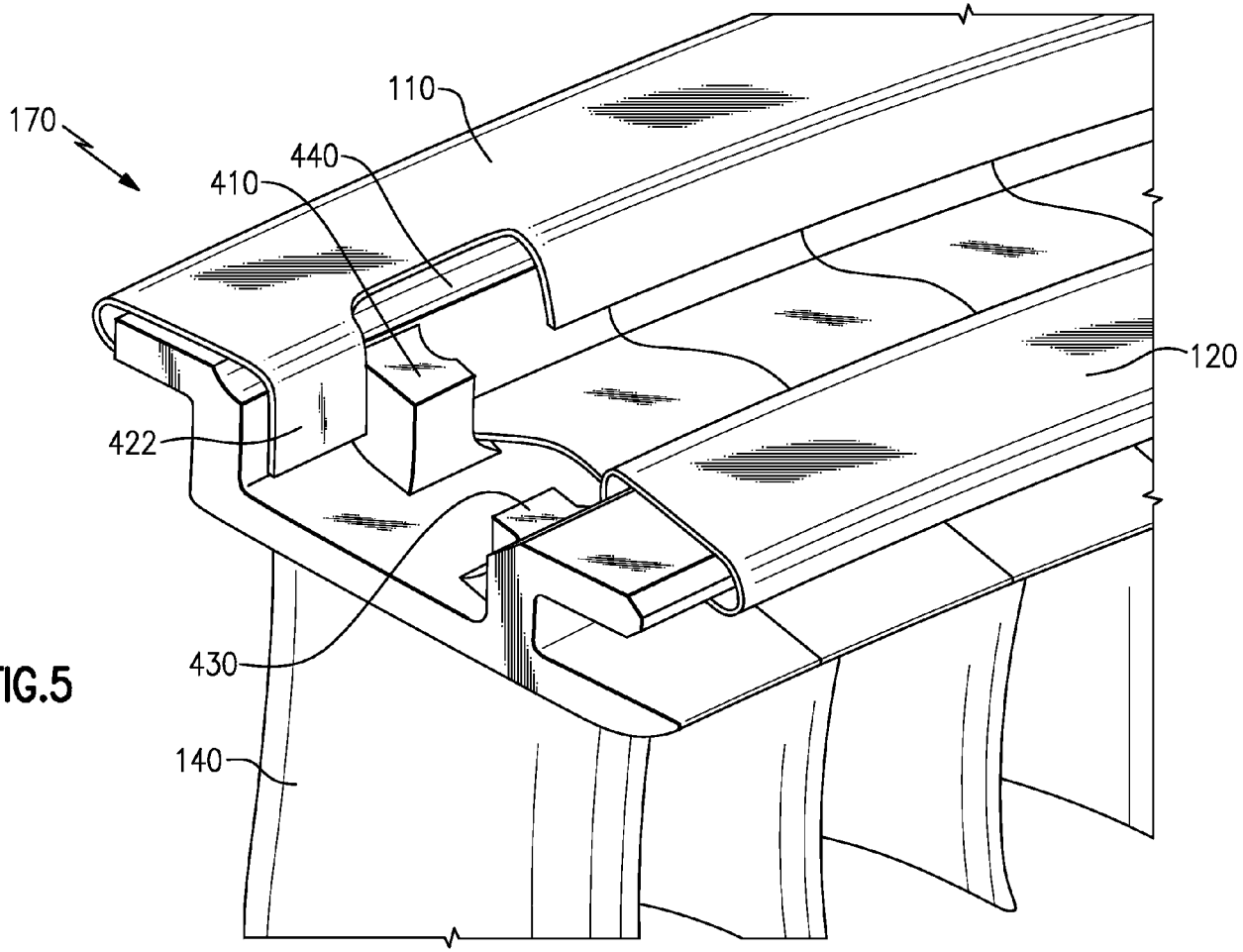
FIG. 5 schematically illustrates a first example end vane singlet vane retention feature of a vane cluster assembly.

On the opposite end of the vane cluster 100, the end vane retention features 170 for the end vane hold the forward wear liner 110 and the aft wear liner 120 in place. With continued reference to FIG. 2, FIG. 5 discloses a first example end vane retention feature 170. In the first example, the end vane 140 includes a forward lug 410 extending from the forward edge, toward the aft edge, of the end vane 140. The end vane 140 also includes an aft lug 430 extending from the aft edge, toward the forward edge, of the end vane 140. In an alternate example, the forward lug 410 and the aft lug 430 can be connected to form a raised wall connecting the forward edge and the aft edge of the end vane 140.

The forward wear liner 110 includes a forward lug gap 440, and the forward lug 410 is snapped into the forward lug gap 440. The forward lug gap 440 is loose fit about the forward lug 410 in the illustrated examples. Alternately, the forward lug gap 440 can be tight fit about the forward lug 410. A tight fitting gap increases the forward wear liner 110 retention capabilities, but also decreases the ease of assembly of the vane cluster 100. In either example, once assembled, an extended forward wear liner flap 422 abuts the forward lug 410, thereby holding the end vane singlet vane 140, the standard singlet vanes 150, and the anti-rotation singlet vane 130 in place in the vane cluster 100.

The aft wear liner 120 abuts the aft lug 430 such that when the end vane 140 is installed in the vane cluster 100, the aft wear liner 120 is contained between the aft lug 430 and the anti-rotation vane wall 230.

Figure 6:
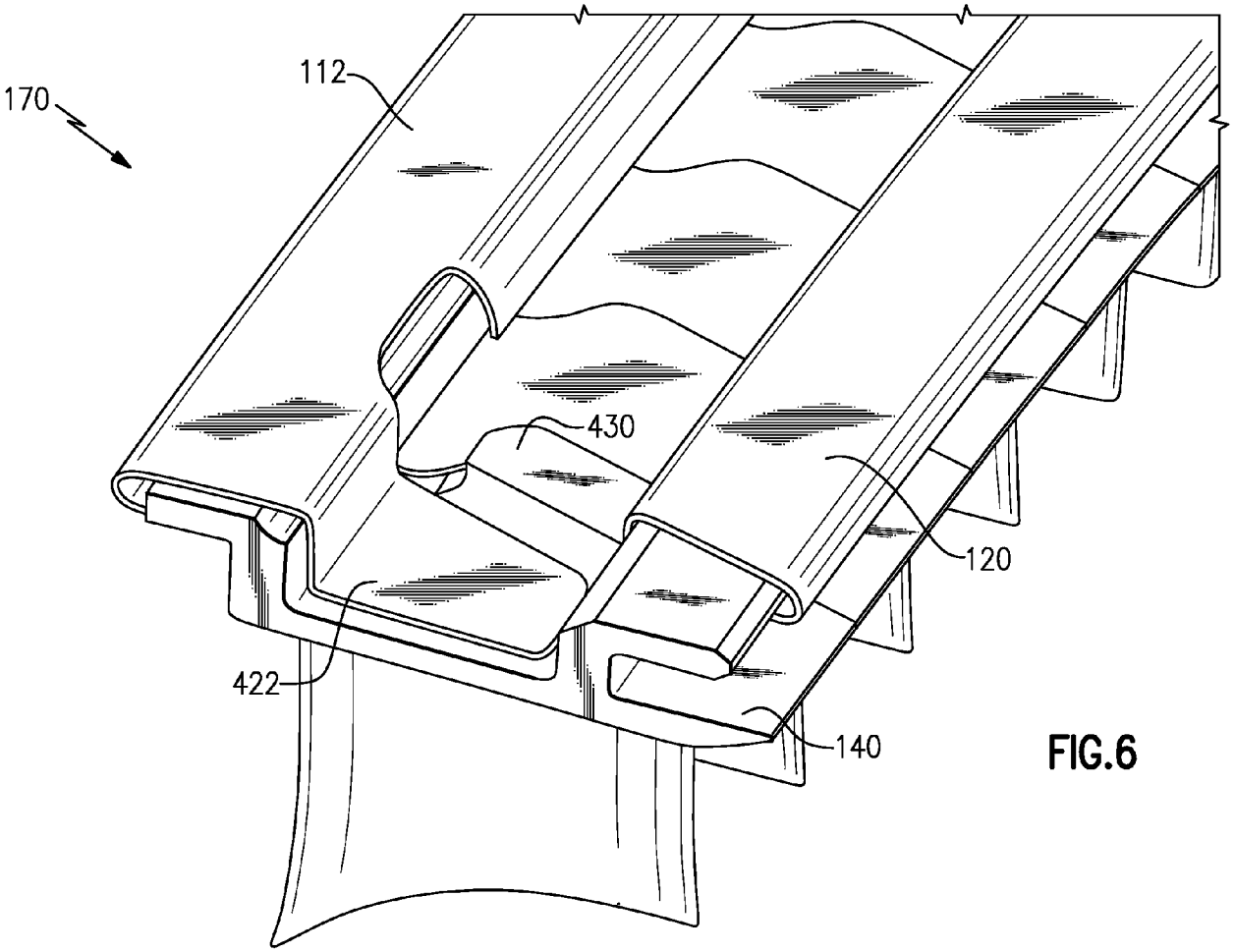
FIG. 6 schematically illustrates a second example end vane singlet vane retention feature of a vane cluster assembly.

FIG. 6 illustrates a second example end vane singlet vane retention feature 170. The second example omits the forward lug 410, and extends the length of the aft lug 430. An extended liner flap 422 abuts an outer edge of the aft lug 430, and is held in place using the aft lug 430 in place of a forward lug 410. In other respects the second example is similar to the first example.

With continued reference to FIGS. 2-6, an assembly method for assembling the vane cluster 100 is described herein. Initially, the forward wear liner 110 is positioned on the anti-rotation singlet vane 130, with the extended forward wear liner flap 222 being received in the forward wear liner retention notch 220, or the anti-rotation notch 210, depending on which type of anti-rotation singlet vane 130 is utilized.

Once the forward wear liner 110 is in position, each of the standard singlet vanes 150 is slid sequentially into the forward wear liner 110. The base portion 152, 132 of each the standard singlet vanes 150, and the anti-rotation singlet vane 130, are configured to interface with the base portion 132, 142, 152 of each adjacent singlet vane 130, 140, 150.

Once all of the standard singlet vanes 150 have been slid into the forward wear liner and interfaced with their adjacent singlet vanes 130, 150, the aft wear liner 120 is slid onto an aft edge of the base portion 132, 152 of each of the singlet vanes 130, 150.

Finally, the end vane singlet vane 140 is snapped into position in the forward wear liner 110, and interfaced with the adjacent standard singlet vane 150, thereby holding each of the vanes in position in the vane cluster 100, and holding the aft wear liner 120 in place. Once the vane cluster 100 is fully assembled, the forward wear liner 110 connects a forward edge of the base portion 132, 142, 152 of each of the singlet vanes 130, 140, 150, and the aft wear liner 120 connects an aft edge of the base portion 132, 142, 152 of each of the singlet vanes 130, 140, 150.

Although each of the example embodiments described above utilizes two separate liners as the forward wear liner 110 and the aft wear liner 120, it is understood that a person of skill in the art could, in light of this disclosure, create a vane cluster 100 utilizing a single wear liner that combined the features both the forward wear liner 110 and the aft wear liner 120 into a single wear liner.

Although a embodiment of this invention has been disclosed, a worker of ordinary skill in this art would recognize that certain modifications would come within the scope of this invention. For that reason, the following claims should be studied to determine the true scope and content of this invention.

The invention claimed is:

1. A gas turbine engine vane cluster comprising:

a plurality of singlet vanes including an anti-rotation singlet vane and an end vane singlet vane, the anti-rotation singlet vane including an anti-rotation feature;

the anti-rotation singlet vane including a raised wall protruding radially outward from a radially outward facing surface of a base portion, the radially outward facing surface being radially outward facing relative to an axis of a gas turbine engine including the gas turbine engine vane cluster, the raised wall having a first radially extending surface and a second radially extending surface, an intrusion is defined in the raised wall;

a forward wear liner connecting a forward edge of each singlet vane in said plurality of singlet vanes, such that said plurality of singlet vanes is operable to be manipulated as a single component, a flap of the forward wear liner extending into, and being retained by, said intrusion in the raised wall; and a vane extending radially inward from said base portion.

2. The gas turbine engine vane cluster of claim 1, wherein said plurality of singlet vanes includes said anti-rotation singlet vane on a first end, said end vane singlet vane on an opposite end, and at least one intermediate singlet vane between said anti-rotation singlet vane and said end vane singlet vane, and wherein each of said singlet vanes in said plurality of singlet vanes interfaces with each adjacent singlet vane in said gas turbine engine vane cluster.

3. The gas turbine engine vane cluster of claim 1, further comprising an aft wear liner connecting an aft edge of each singlet vane in said plurality of singlet vanes, wherein said forward wear liner and said aft wear liner are separate liners.

4. The gas turbine engine vane cluster of claim 3, wherein said end vane singlet vane includes a forward retention lug interfaced with said forward wear liner and an aft retention lug interfaced with said aft wear liner.

5. The gas turbine engine vane cluster of claim 3, wherein said aft wear liner comprises an end vane singlet vane interface feature, wherein said end vane singlet vane interface feature is a notch on an end of said aft wear liner, and wherein an aft end vane singlet vane liner interface lug interfaces with said end vane singlet vane interface feature.

6. The gas turbine engine vane cluster of claim 1, wherein each singlet vane other than the anti-rotation singlet vane in the plurality of singlet vanes does not have said anti-rotation feature.

7. The gas turbine engine vane cluster of claim 1, wherein the intrusion defined in the raised wall radially intrudes into said raised wall and intrudes into said raised wall along a circumference of the gas turbine engine.

8. The gas turbine engine vane cluster of claim 1, wherein the raised wall of the anti-rotation singlet vane is at an axially aligned edge of the anti-rotation singlet vane, the axially aligned edge being axially aligned relative to the axis of the gas turbine engine including the gas turbine engine vane cluster, and the raised wall is adjacent an edge of another singlet vane in said plurality of singlet vanes.

9. The gas turbine engine vane cluster of claim 1, wherein a portion of the raised wall is received in a gap defined in the forward wear liner.

10. The gas turbine engine vane cluster of claim 9, wherein the gap defined in the forward wear liner is defined between the flap of the forward wear liner, and a radial wall of said forward wear liner.

11. The gas turbine engine vane cluster of claim 1, wherein each of the first radially extending surface and the second radially extending surface face away from each other.

12. The gas turbine engine vane cluster of claim 1, wherein the forward wear liner is a single piece.

13. A method of assembling the gas turbine engine vane cluster according to claim 1, the method comprising the steps of:

positioning the anti-rotation singlet vane in the forward wear liner, such that said intrusion retains said flap thereby holding said forward wear liner in place;

sliding at least one standard singlet vane of the plurality of singlet vanes into said forward wear liner, such that said forward wear liner connects the forward edge of each singlet vane in said plurality of singlet vanes;

sliding an aft wear liner onto an aft edge of each standard singlet vane, such that a first edge of the aft wear liner abuts the anti-rotation singlet vane; and sliding the end vane singlet vane into said forward wear liner and said aft wear liner such that a forward retention lug of the end vane singlet vane snaps into an end vane singlet vane interface feature of said forward wear liner, and an aft retention lug of the end vane singlet vane slides into an end vane singlet vane interface feature of said aft wear liner.

14. The method of claim 13, wherein said step of sliding said at least one standard singlet vane of the plurality of singlet vanes into said forward wear liner, such that said forward wear liner connects the forward edge of each singlet vane in said plurality of singlet vanes further comprises: interfacing each singlet vane in said plurality of singlet vanes with each adjacent singlet vane in said plurality of singlet vanes in the gas turbine engine vane cluster.

15. The method of claim 13, wherein said step of sliding said aft wear liner onto said aft edge of each standard singlet vane, such that said first edge of the aft wear liner abuts the anti-rotation singlet vane further comprises: connecting said aft edge of each of said standard singlet vanes and an aft edge of said end vane singlet vane.

16. The method of claim 13, wherein said step of sliding said at least one standard singlet vane of the plurality of singlet vanes into said forward wear liner, such that said forward wear liner connects the forward edge of each singlet vane in said plurality of singlet vanes further comprises: sliding a specialized singlet vane into said forward wear liner.

17. A gas turbine engine comprising:

a compressor section;

a combustor in fluid communication with the compressor section;

a turbine section in fluid communication with the combustor;

a vane assembly, wherein said vane assembly comprises a plurality of gas turbine engine vane clusters arranged in a ring about a centerline axis of the gas turbine engine; and wherein each gas turbine engine vane cluster of said plurality of gas turbine engine vane clusters comprises a plurality of singlet vanes including an anti-rotation singlet vane and an end vane singlet vane, the anti-rotation singlet vane including an anti-rotation feature;

the anti-rotation singlet vane including a raised wall protruding radially outward from a radially outward facing surface of a base portion, the radially outward facing surface being radially outward facing relative to the centerline axis of the gas turbine engine, the raised wall having a first radially extending surface and a second radially extending surface, an intrusion is defined in the raised wall; and a forward wear liner connecting a forward edge of each singlet vane in said plurality of singlet vanes, such that said plurality of singlet vanes is operable to be manipulated as a single component, a flap of the forward wear liner extending into, and being retained by, said intrusion in the raised wall; and a vane extending radially inward from said base portion.

18. The gas turbine engine of claim 17, wherein each of said plurality of gas turbine engine vane clusters includes an identical number of singlet vanes.

19. The gas turbine engine of claim 18, wherein each of said plurality of gas turbine engine vane clusters is identical.

20. The gas turbine engine of claim 17, wherein said plurality of gas turbine engine vane clusters comprises at least a first vane cluster configuration and a second vane cluster configuration, wherein each of said first vane cluster configuration and said second vane cluster configuration is different.

21. The gas turbine engine of claim 20, wherein said first vane cluster configuration and said second vane cluster configuration each contain a different number of singlet vanes.

* * * * *